US006296135B1

(12) United States Patent
Anderson et al.

(10) Patent No.: US 6,296,135 B1
(45) **Date of Patent: *Oct. 2, 2001**

(54) VENT-ON-DEMAND HATCH COVER

(75) Inventors: John D. Anderson; Walter J. Peach, Jr., both of Aurora, IL (US)

(73) Assignee: ZefTek, Inc., Montgomery, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/384,730

(22) Filed: Aug. 27, 1999

(51) Int. Cl.[7] ..... B65D 51/16

(52) U.S. Cl. ..... 220/203.23; 105/377.05; 220/203.01; 220/373; 220/374; 220/844

(58) Field of Search ..... 105/377.07; 220/203.01, 220/203.04, 203.07, 203.09, 203.1, 203.19, 203.23, 203.29, 367.1, 373, 374, 848, 844; 215/260, 262, 311, 315

(56) References Cited

U.S. PATENT DOCUMENTS

| | | | | |
|---|---|---|---|---|
| 2,776,070 | * | 1/1957 | Phillips | 220/203.11 |
| 3,295,545 | * | 1/1967 | Papell et al. | 220/203.23 X |
| 4,081,107 | * | 3/1978 | Martin, Jr. et al. | 220/374 |
| 4,278,107 | | 7/1981 | Dugge et al. . | |
| 4,315,579 | | 2/1982 | Martin, Jr. . | |
| 4,323,096 | | 4/1982 | Dugge . | |
| 4,398,557 | | 8/1983 | Dugge . | |
| 4,501,377 | * | 2/1985 | Palmer, III | 105/377.07 X |
| 4,819,830 | | 4/1989 | Schultz . | |
| 5,064,089 | * | 11/1991 | Schultz | 220/371 X |
| 5,246,027 | * | 9/1993 | Morris | 220/203.29 X |
| 5,404,903 | * | 4/1995 | Anderson et al. | 220/203.1 X |
| 5,660,295 | * | 8/1997 | Hroma et al. | 215/315 X |
| 5,673,897 | * | 10/1997 | Crochet et al. | 105/377.07 X |
| 5,813,352 | * | 9/1998 | Bramlett et al. | 105/377.07 |
| 5,960,980 | * | 10/1999 | Burke et al. | 220/367.1 X |
| 6,050,199 | * | 4/2000 | Anderson et al. | 105/377.07 |
| 6,076,471 | * | 6/2000 | Burian et al. | 105/377.07 |

* cited by examiner

*Primary Examiner*—Allan N. Shoap
*Assistant Examiner*—Robin A Hylton
(74) *Attorney, Agent, or Firm*—Lloyd E. Zickert

(57) ABSTRACT

A vent-on-demand hatch cover for closing a hatch opening of a compartment in a railcar, and particularly a hopper car, wherein the car is provided with a coaming that defines the opening. The cover includes a peripheral opening for taking in the outside air and which is disposed adjacent the outer side of the coaming and an inside opening at the underside of the cover exposed to the compartment for connecting the cover to the compartment air. Passageways are provided between the two openings in order to allow air flow between the outside of the car and the inside of the car. A closure member is provided at the inside opening of the cover which is resiliently biased normally into closed position and which opens upon the formation of a vacuum within the compartment in order to allow unloading of the compartment.

12 Claims, 2 Drawing Sheets

VENT-ON-DEMAND HATCH COVER

DESCRIPTION

This invention relates in general to a hatch cover for a hatch opening of a railcar, and more particularly to a vent-on-demand hatch cover for a hopper car which normally maintains a closed and sealed relation between the outside air and the compartment and which allows air flow into the compartment when a vacuum is produced inside the compartment.

BACKGROUND OF THE INVENTION

Heretofore, it has been well known to provide hatch covers for railcars. More particularly, the heretofore known vented hatch covers included passageways with openings to the outside air and to the compartment which is closed by the cover for the purposes of allowing the venting of air between the outside and the compartment and which allow unloading of the contents without removing the cover. Where shippers of goods want to assure no contaminants can be transferred by air flow, a non-vented hatch cover is used.

When unloading a compartment of a railcar having non-vented hatch covers, it is necessary to remove the hatch covers in order to provide sufficient air flow into the compartment to allow the contents to be discharged from the compartment and also to eliminate any implosion risks during unloading operations.

Accordingly, there is a need to provide a hatch cover for a hatch opening that will seal out contaminants during shipping while also allowing unloading without the necessity of removing the hatch cover from the opening.

SUMMARY OF THE INVENTION

The present invention relates to a vent-on-demand hatch cover that solves a problem heretofore known where it is necessary to remove a hatch cover for unloading of a compartment of a hopper car where it is desired to seal off the hatch openings against contaminants entering the compartment during shipping. Except for the vent-on-demand feature of the hatch cover of the present invention, the hatch cover is similar to the vented hatch cover in copending application 08/868,463, ('463 application) filed Jun. 3, 1997 now Pat. No. 5,960,980, and assigned to the assignee of this application. Accordingly, the disclosure in that copending application is incorporated herein by reference.

The hatch cover in the '463 application includes an upper member and a lower member in assembled relation which defines peripheral openings for the outside air and a central opening for communication with the inside compartment air, and interconnecting passageways for controlling the air flow and reducing the entry of contaminants into the compartment during shipping. Thus, the vented hatch cover in the '463 application continually allows the venting of air and the air flow between the ambient and the compartment during the time that the cover is in place on the hatch opening. Moreover, the vented hatch cover of the '463 application allows unloading of the compartment without the necessity of removing the hatch cover as air can flow into the compartment through the air flow passageways.

The present invention differs from that disclosed in the '463 application in that a closure member is provided for the opening in the cover that communicates with the interior of the compartment. This closure member is resiliently biased into closed position and opens on demand during unloading operations or whenever the pressure within the compartment differentiates sufficiently from the outside pressure. Thus, all implosion risks are avoided. Further, the closure member opens during unloading when venting is needed and thereafter closes automatically when a car unloading operation is completed in order to seal out any possible entry of contaminants.

It is therefore an object of the present invention to provide a vent-on-demand hatch cover that allows venting on demand during unloading operations.

A further object of the present invention is in the provision of a vent-on-demand hatch cover for a railcar that includes a closure member normally resiliently biased into closed position and openable upon reduction of the air pressure within the compartment of a railcar during unloading operations or during any other unusual air pressure differential situations.

Other objects, features and advantages of the invention will be apparent from the following detailed disclosure, taken in conjunction with the accompanying sheets of drawings, wherein like reference numerals refer to like parts.

DISCLOSURE OF THE INVENTION

Figure 1:
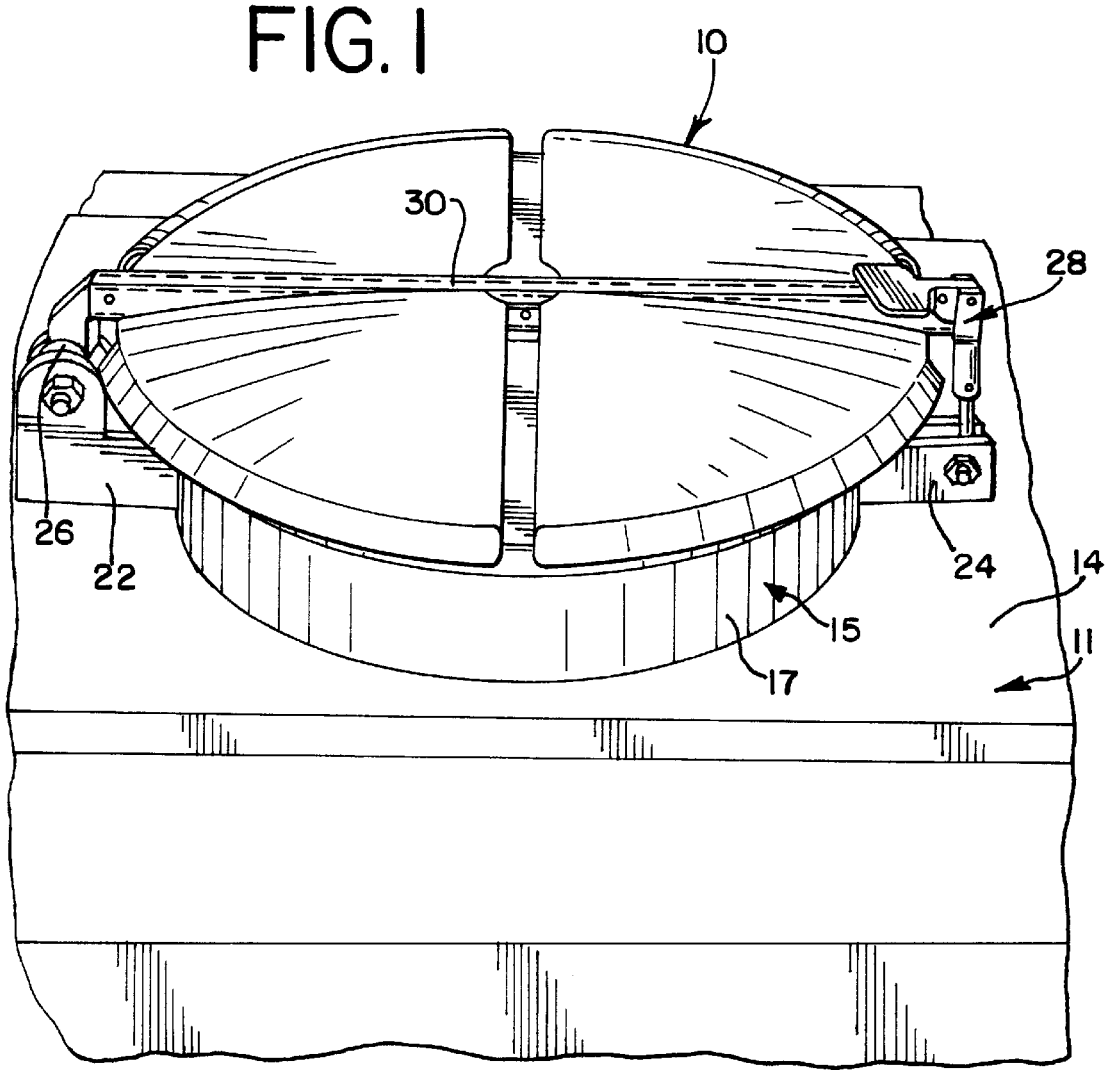
FIG. 1 is a fragmentary perspective view of the top side of a hopper car including a coaming and the vent-on-demand hatch cover according to the present invention.
Figure 2:
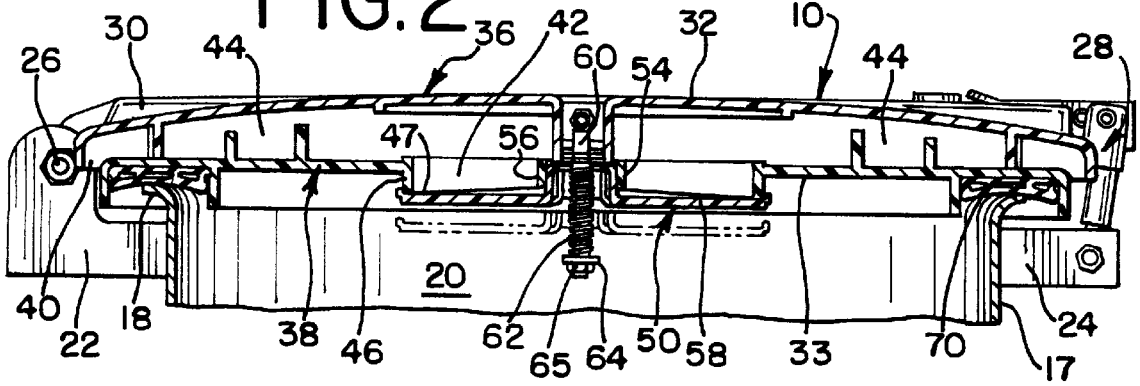
FIG. 2 is a transverse sectional view taken through the hatch cover of FIG. 1 to show the closure member for the inside opening of the cover and illustrating the member in closed position in solid lines and in open position in phantom.

Referring now to the drawings, and particularly to FIGS. 1 and 2, the vent-on-demand hatch cover according to the invention is generally designated by the numeral and shown in closed position over a hatch opening of a railcar 11. It will be appreciated that the hatch cover of the invention will be used on closed hopper cars having any number of compartments for carrying various products including granular and pelletized materials. Such materials are shipped by rail, wherein the cars are loaded at a loading station by opening the cover and thereafter discharged from the railcar by bottom discharge doors which are not shown.

The railcar 11 includes a roof 14 on which a coaming 15 is mounted at an opening in the roof. The coaming is suitably secured to the roof 14 such as by welding or otherwise and provides an upstanding cylindrical wall 17 terminating in an annular rolled over edge or lip 18 to define a hatch opening 20 for the compartment carrying product.

The coaming includes hinge brackets 22 along one side and diametrically opposite therefrom toggle locking brackets 24. The hinge brackets provide a hinge 26 for which the cover is hingedly connected to the railcar while the toggle locking brackets 24 provide a mounting for a toggle locking device 28 which serves to selectively lock the cover in closed and sealed position or allow the cover to be swung back in open position for loading. A locking arm 30 extends across the top of the cover to hinge the cover at the hinge 26 and also serve to coact with the toggle locking device 28 at the opposite side of the cover. The details of the locking device are more particularly described in the '463 application.

The hatch cover 10 includes an upper side 32 and a lower side 33, wherein the upper side is exposed to the ambient or outside air, while the underside is exposed to the air in the compartment of the car. As more specifically described in the '463 application, the cover 10 includes an upper member 36 and a lower member 38 that coact to define a peripheral and downwardly directed opening 40 at the outside of the car and adjacent to the outer surface of the coaming, and a central inner opening 42 at the underside of the cover and exposed to the hatch opening 20 and the product compartment of the car. A plurality of radially extending passageways 44 allow air flow between the outside opening 40 and the inside opening 42. As described in the prior application, these passageways provide circuitous passageways for the air that function to inhibit the flow of contaminants into the compartment from the outside of the car. As will be more clearly described below, no air will flow in the passageways except when the pressure within the compartment is lower than that of the outside ambient air because of the closure member provided for the inside opening 42.

As seen particularly in FIG. 2, the inside opening 42 is defined by a cylindrical wall 46 having an annular edge or rim 47 at the lower end of the wall. A disc-shaped closure member 50 is mounted for selectively seating on the annular edge 47 to close the opening 42.

A plurality of radially extending ribs 52 extend inwardly from the cylindrical wall 46 to support a socket 54 centrally disposed within the opening 42. The socket coacts with the closure member 50 as described below.

The closure member 50 includes a central hat-shaped portion or hub 56 and a radially extending disc-shaped member 58. In closed position, the closure member 50 abuts against the annular rim or edge 47 of the cylindrical wall 46, while the hat-shaped portion 56 is freely received within the socket 54. A shaft 60 is anchored into the cover and extends downwardly beyond the underside of the cover. The shaft may be in the form of a bolt having a sleeve or bushing thereon and which also then receives a coil spring 62. A hole is provided in the center of the hat-shaped hub 56 to mate with the shaft.

Figure 3:
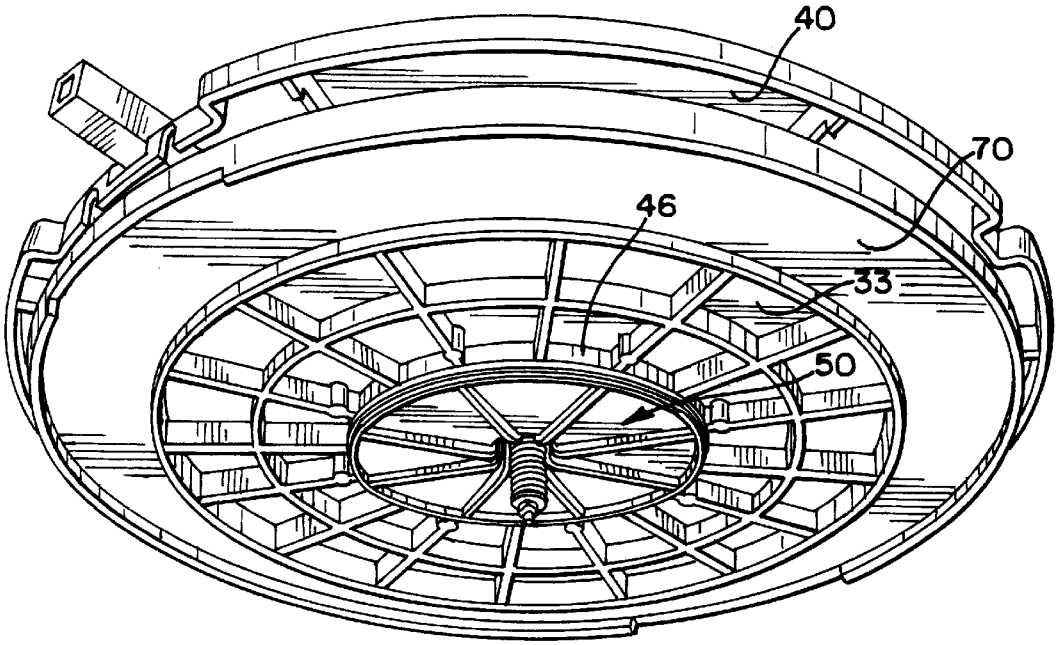
FIG. 3 is an underside perspective view of the cover of FIG. 2 showing the closure member of the cover in closed position.
Figure 4:
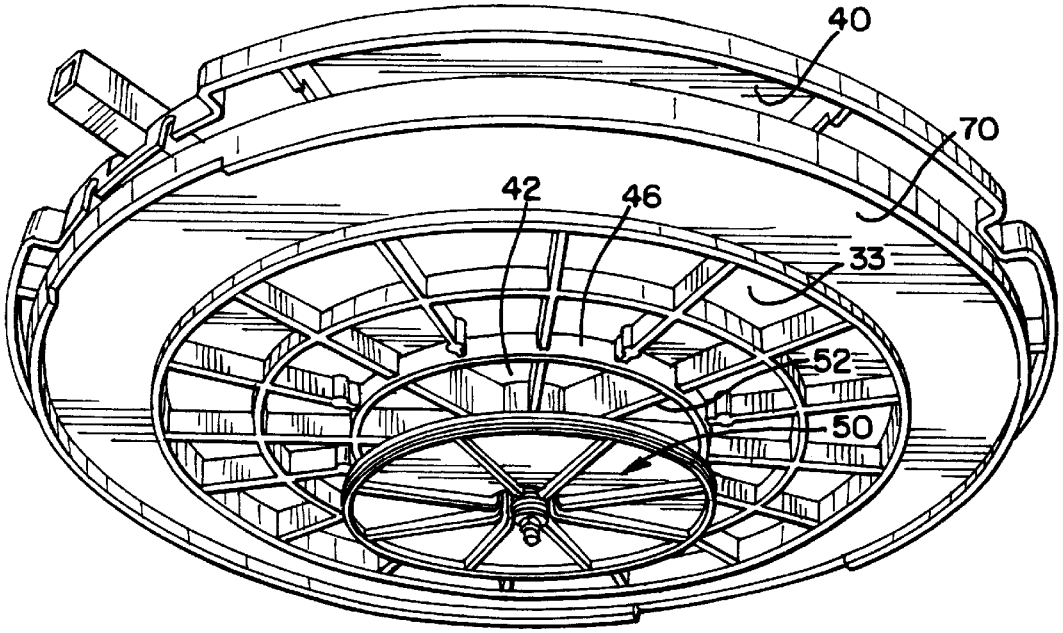
FIG. 4 is a view similar to FIG. 3 but showing the closure member in open position.

The upper end of the coil spring 62 is bottomed against the inside surface of the hat-shaped hub of the closure member, while the lower end of the spring is bottomed against a washer 64 held in place by a nut 65. It will be appreciated that the tension on the spring 62 may be adjusted by the adjustment of the nut 65 which is in the form of a suitable lock nut having a nylon insert. Further, a rubber washer is provided on the top side of the hat-shaped hub for purposes of sealing against the entry of air around the hole that accommodates the shaft. Thus, the closure member 50 is resiliently biased into closed position, as shown in solid lines in FIG. 2 and as shown in FIG. 3.

It will further be appreciated that an annular resilient sealing member 70 is provided peripherally at the underside of the cover to engage the rolled edge 18 of the coaming to seal against the entry of air or contaminants into the compartment, as set forth in the '463 application.

In operation, the vent-on-demand hatch cover 10, when in closed position on the hatch opening as shown in FIG. 2, would normally provide the closure member 50 biased to closed and sealed position as shown. Upon the unloading of the contents of the compartment and the producing of a vacuum within the compartment or a lower pressure than the outside air, the closure member automatically opens against the biasing of the spring 62 to allow air flow into the compartment and facilitate the unloading process. Once the unloading has concluded, the closure member automatically moves to closed position in response to the forces of the spring in order to seal off the air flow between the outside and the compartment.

While the configuration of the hatch cover illustrated for the particular coaming illustrated is circular in shape, it will be appreciated that polygonally shaped hatch openings would likewise be closed with a polygonally shaped hatch cover. The vent-on-demand feature of the hatch cover according to the invention could likewise be illustrated in a polygonally shaped hatch cover and either be configured as a circular closure member or a polygonal closure member.

It will be understood that modifications and variations may be effected without departing from the scope of the novel concepts of the present invention, but it is understood that this application is to be limited only by the scope of the appended claims.

What is claimed is:

1. A vent-on-demand hatch cover for a hatch opening of a compartment in a railcar, wherein the hatch opening includes a coaming, said cover having an upper side and an underside and comprising:

a resilient peripheral seal provided at the underside of the hatch cover engaging the coaming to define a substantially airtight seal between the cover and the opening, a peripheral opening adjacent the coaming for communicating with the outside atmosphere, a central opening at the underside of the cover for communicating with the compartment, an airflow passageway for interconnecting said peripheral and central openings, and means for normally closing the central opening to prevent the flow of air from the compartment and the entry of contaminants into the compartment and operable for allowing air to flow into the compartment when the air pressure within the compartment is less than atmosphere, said central opening including a valve seat, a valve member and means resiliently biasing said valve member into closed position on said valve seat, the upper side of the valve member being exposed to the outside atmosphere and the underside of the valve member being exposed to the compartment, whereby said valve member moves downwardly into the compartment to open said central opening.

2. The cover of claim 1, wherein the biasing of said valve member is adjustable.

3. The cover of claim 1, wherein said valve seat is substantially circular, and said valve member is disc-shaped.

4. The cover of claim 3, wherein a centrally disposed socket is provided at the underside of the cover, and said valve member includes a centrally disposed hat-shaped portion mating in said socket when the disc-shaped member is in closed position to the central opening.

5. The cover of claim 4, wherein said biasing means includes a spring.

6. The cover of claim 5, wherein said guide means comprises a shaft secured to the cover and extending downwardly therefrom, and said disc-shaped member having a central hole sized to mate with the shaft whereby the member is slidably carried on the shaft.

7. The cover of claim 6, wherein the biasing means includes a coil spring on said shaft.

8. The cover of claim 7, wherein a seal is provided between the disc-shaped member and the cover around the shaft.

9. The cover of claim 1, wherein said biasing means includes a spring.

10. The cover of claim 1, wherein means extends from the cover to guide the opening and closing movement of the valve member.

11. The cover of claim 10, wherein said guide means comprises a shaft secured to the cover and extending downwardly therefrom, and said valve member includes a central hole sized to mate with the shaft whereby the member is slidably carried on the shaft.

12. The cover of claim 11, wherein the biasing means includes a coil spring on said shaft.

* * * * *